US009523264B2

(12) United States Patent
Broussard et al.

(10) Patent No.: US 9,523,264 B2
(45) Date of Patent: Dec. 20, 2016

(54) GRAVEL PACK CROSSOVER TOOL WITH LOW DRAG FORCE

(75) Inventors: John P. Broussard, Kingwood, TX (US); Patrick J. Zimmerman, Houston, TX (US); Christopher Hall, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 1074 days.

(21) Appl. No.: 13/294,487

(22) Filed: Nov. 11, 2011

(65) Prior Publication Data

US 2013/0118726 A1 May 16, 2013

(51) Int. Cl.
*E21B 43/04* (2006.01)

(52) U.S. Cl.
CPC ..... *E21B 43/045* (2013.01)

(58) Field of Classification Search
CPC ..... E21B 43/04; E21B 43/08; E21B 43/045
USPC ..... 166/51, 278, 325, 386
See application file for complete search history.

(56) References Cited

U.S. PATENT DOCUMENTS

| | | | | |
|---|---|---|---|---|
| 4,044,832 | A | 8/1977 | Richard et al. | |
| 4,106,565 | A | 8/1978 | Braddick | |
| 4,296,807 | A | 10/1981 | Hendrickson et al. | |
| 4,428,428 | A * | 1/1984 | Smyrl et al. | 166/278 |
| 4,858,690 | A | 8/1989 | Rebardi et al. | |
| 5,174,379 | A | 12/1992 | Whiteley et al. | |
| 5,348,092 | A | 9/1994 | Cornette et al. | |
| 5,597,040 | A | 1/1997 | Stout et al. | |
| 5,921,318 | A | 7/1999 | Ross | |
| 5,988,271 | A | 11/1999 | Oneal et al. | |
| 6,364,017 | B1 | 4/2002 | Stout et al. | |
| 6,382,319 | B1 | 5/2002 | Hill, Jr. et al. | |
| 6,491,097 | B1 * | 12/2002 | Oneal et al. | 166/278 |
| 6,789,623 | B2 | 9/2004 | Hill, Jr. et al. | |
| 7,128,151 | B2 | 10/2006 | Corbett | |
| 2001/0027867 | A1 | 10/2001 | Gandy et al. | |
| 2003/0192694 | A1 | 10/2003 | Zachman et al. | |
| 2004/0069489 | A1 | 4/2004 | Corbett | |
| 2005/0103495 | A1 | 5/2005 | Corbett | |
| 2009/0065193 | A1 | 3/2009 | Corbett | |
| 2009/0145603 | A1 | 6/2009 | Coronado | |
| 2009/0301723 | A1 * | 12/2009 | Gray | 166/301 |

(Continued)

FOREIGN PATENT DOCUMENTS

WO 2006/041825 A2 4/2006

OTHER PUBLICATIONS

Weatherford International Ltd., "Retrievable Seal-Bore Packer Gravel-Pack System," Brochure, copyright 2005.

(Continued)

*Primary Examiner* — David Andrews
*Assistant Examiner* — Kristyn Hall
(74) *Attorney, Agent, or Firm* — Blank Rome LLP

(57) ABSTRACT

A gravel pack assembly has a longitudinal body that disposes in a borehole. A wellscreen and other components can connect to the body to complete the assembly. One or more packoff seals or bushings disposed in the body's inner passage can engage a smooth external surface of a crossover tool when disposed therein to prevent passage of sand and fluids between the tool and the assembly's inner passage. The packoff seals or bushings can be fixed or activated by movement to engage the smooth external surface of the crossover tool.

20 Claims, 7 Drawing Sheets

(56) References Cited

U.S. PATENT DOCUMENTS

| | | | |
|---|---|---|---|
| 2011/0048704 | A1 | 3/2011 | Clem et al. |
| 2011/0132613 | A1 | 6/2011 | Xu |

OTHER PUBLICATIONS

Weatherford International Ltd., "WFX Gravel Pack System," Brochure, copyright 2006.
Weatherford International Ltd., "BlackCat GP Packer for the Model 4P Gravel-Pack System," Brochure, copyright 2007.
Weatherford International Ltd., "Model G2 Frac-Pack Extension," Brochure, copyright 2007.
Weatherford International Ltd., "Model WFX Crossover Tool," Brochure, copyright 2007-2008.
Weatherford International Ltd., "Model WFX Crossover Tool," Brochure, copyright 2007-2010.
Weatherford International Ltd., "Take Control: WFX Fixed-Position Sand-Control Completion System," Brochure, copyright 2008.
Weatherford International Ltd., "Model 4P Washdown Crossover Tool," Brochure, copyright 2010.
Weatherford International Ltd., "Model 4P Crossover Tool," Brochure, copyright 2010.
Weatherford International Ltd., "Model 4P Shifting Tool," Brochure, copyright 2010.
Weatherford International Ltd., "Gravel-Pack Closing Sleeve: Model G1," Brochure, copyright 2007-2010.
Weatherford International Ltd., "Model G2 Frac-Pack Extension," Brochure, copyright 2007-2010.
First Office Action in counterpart Canadian Appl. 2,794,296, mailed Mar. 25, 2014.
First Office Action in counterpart Australian Appl. 2012244166, mailed Mar. 20, 2014.
Second Office Action in counterpart Canadian Appl. 2,794,296, mailed Jan. 15, 2015.
Extended Search Report received in counterpart EP Appl. 12192034.2—1610/2592221, mailed Jul. 15, 2015.
Third Office Action in counterpart Canadian Appl. 2,794,296, mailed Oct. 20, 2015.
Fourth Office Action in counterpart Canadian Appl. 2,794,296, mailed Aug. 23, 2016, 4-pgs.

* cited by examiner

GRAVEL PACK CROSSOVER TOOL WITH LOW DRAG FORCE

BACKGROUND

Operators may perform a gravel or frac pack operation in a well to reduce the inflow of unwanted contaminants. In a gravel pack operation, operators deploy a gravel pack assembly down a wellbore and pump a slurry of liquid and gravel (e.g., sand) down a workstring and redirect the slurry to the annulus. Typically, the gravel pack assembly has a packer to seal the wellbore, a crossover tool connected below the packer to redirect the slurry, and a gravel-pack extension with a screen to filter returns.

When gravel is pumped downhole, the crossover tool acts as a conduit for the gravel, allowing it to fill in the annulus below the packer and around the screen. As the gravel fills the annulus, it becomes tightly packed and acts as an additional filtering layer along with the wellscreen to prevent the collapse of the wellbore. When the wellbore is then produced, the gravel around the screen filters the produced fluid produced from the formation and prevents the contaminants from entering the stream of production fluids produced to the surface.

As shown in FIGS. 1A-1E, for example, a gravel pack assembly 100 extends downhole in a borehole 10, which can be an open or cased hole. The gravel pack assembly 100 has an uphole packer 110, an extension 120, a wellscreen 130, and a lower packer 135. A crossover tool 140 disposes through the packer 110 and into the extension 120 to perform gravel or frac pack operations as detailed below.

After running-in as shown in FIG. 1A, the crossover tool 140 can be placed in a circulating position (FIG. 1B), a squeeze position (FIG. 1C), or a reverse position (FIG. 1D) depending on the upward and downward movement of the work string.

To circulate through the assembly 100 as in FIG. 1B, for example, operators move the crossover tool 140 to the circulating position and drop a ball 166 to close and move an inner check valve 165. This allows fluid pumped down the inner workstring 14 to pass out the crossover tool's ports 156 and the extension's ports 124 into the annulus. Returning through the wellscreen 130, the circulated fluid can enter the tool's washpipe 180 and return up the crossover tool 140 to the return ports 154 above the packer 110.

To frac the formation, for example, operators move the crossover tool 140 to the squeeze position shown in FIG. 1C so the crossover ports 156 align with the flow ports 124 of the gravel-pack extension 120. During the frac, a slurry of proppant and carrying fluid is pumped into the annulus between the wellscreen 130 and the borehole 10 so the proppant can treat the formation around the borehole 10 by entering through perforations 12. (An open hole arrangement would not have perforations 12 and the like.) In this squeeze position, operators pump fluids straight into the formation without transmission of fluid or pressure to the casing annulus above the packer 110. In this way, fluid can be injected down the workstring 14 and into the annulus around the screen 130 without exposing the upper casing to injection pressures and fluid.

To gravel pack, operators fill the annulus between the wellscreen 130 and the borehole 10 with gravel by pumping a slurry of fluid and gravel (i.e., graded sand) into the borehole 10 to pack the annulus. For example, moving the crossover tool 140 to the circulating position shown in FIG. 1B exposes the ports 156 and 124 to the casing annulus as noted above. A slurry of gravel and carrying fluid pumped down the work string 14 can circulate in the annulus and around the wellscreen 130. Held by the wellscreen 130, the gravel then packs in the annulus, while return fluids flow through the wellscreen 130 and up the washpipe 180. Eventually, the fluid passes through the return bypass 158 of the crossover tool 140 and out return ports 154 into the annulus above the packer 110. Thus, the circulating position directs the slurry to pack the annulus as discussed previously.

To achieve a reverse position as shown in FIG. 1D, operators raise the crossover tool 140 further until its crossover ports 156 dispose uphole of the packer 110. This isolates the formation so operators can reverse out or circulate fluid above the packer 110. During recirculation, excess sand slurry can be circulated to the surface after gravel packing has been completed. Finally, as shown in FIG. 1E, the assembly 100 can be set up for production by installing a production seal assembly 190 in the packer 110 and extension 120.

FIGS. 2A-2C show the crossover tool 140 according to the prior art disposed in portion of the gravel pack assembly 100, while FIGS. 3A-3C show the crossover tool 140 according to the prior art in detail. As noted previously, the gravel pack assembly 100 has the packer 110 (with mandrel 112, packing element 116, and slip assembly 118) and has the extension 120. Wellscreens and other components are not shown in these Figures.

This crossover tool 140 is similar to the "Model 4P Crossover Tool" available from Weatherford. A setting tool 142 (only a portion of which is shown) on the crossover tool 140 is used to set the packer 110 in the borehole. Upper and lowers housings 150 and 170 on the tool 140 have multiple subassemblies 151/171 with bonded seals 153/173 disposed thereabout for engaging in the gravel pack assembly 100. In particular, the crossover tool 140 has four upper subassemblies 151*a-d* coupled to one another and uses four external seal rings 153. The tool 140 has a ported subassembly 155 having the crossover ports 156 and the return bypass 158. Additionally, the crossover tool 140 can have eleven lower subassemblies 171*a-k* coupled to one another below the ported subassembly 155 and can use twelve external seal rings 173. The lower end of the crossover tool 140 has a check-valve (i.e., ball and seat arrangement 175) to accept flow into and prevent flow out the lower end.

After the gravel pack operation as in FIG. 1C, the crossover tool 140 can become stuck in the gravel pack assembly 100, and efforts to retrieve the stuck tool 140 can lead to mechanical failures. To prevent the tendency of sticking of a crossover tool, operators have attempted to reduce any void spaces where gravel can settle around the crossover tool inside the gravel pack extension. Alternatively, the crossover tool can use a check valve in an evacuation port, such as disclosed in U.S. Pat. No. 7,032,666. After pumping the sand downhole and before trying to move the crossover tool, the check valve allows operators to pump fluid down the casing to evacuate any residual sand from where it is likely to settle.

Even with these efforts to prevent sticking, the standard crossover tool still has drawbacks. In particular, the standard crossover tool, such tool 140 shown in FIGS. 2A-2C and 3A-3C, has numerous outward facing seal rings 153/173 mounted on the crossover tool 140. These rings 153/173 move through the stationary polished sealing surfaces 126 (FIG. 2B) of the extension's bore 122 inside the gravel pack assembly 100. When gravel surrounds the crossover tool 140, moving it through or into the seal bore 122 requires the sand to displace or requires the seal rings 153/173 to compress enough for the crossover tool 140 to move. Both of these situations are less than ideal and can result in sticking of the tool 140 in the assembly 100.

The subject matter of the present disclosure is directed to overcoming, or at least reducing the effects of, one or more of the problems set forth above.

SUMMARY

A borehole gravel pack assembly has a longitudinal body that disposes in a borehole. The body has a packer that engages in the borehole to isolate a portion of the annulus. The body also has an extension that extends downhole from the packer. A wellscreen and other component connect to the extension and complete the gravel pack assembly.

On the body, an inner passage passes from end to end through the packer and extension, and a flow port defined in the extension communicates the inner passage outside the body to the isolated annulus of the borehole. This flow port allows fluid (e.g., slurry, gravel, frac fluids, etc.) to communicate between the extension and the borehole annulus during gravel pack and frac pack operations.

A crossover tool is manipulated in the packer and extension to direct slurry and fluids during the gravel pack and frac pack operations. In particular, the crossover tool has an open distal end that allows fluid returns to pass up the tool to a workstring or the borehole above the packer depending on the position of the tool. The crossover tool also has a cross port that can communicate with the extension's flow port. Finally, the tool has a bypass port at its uphole end that can communicate with the borehole above the packer depending on the tool's position.

For sealing inside the assembly, the crossover tool has a uniform and smooth exterior surface on both sides of the cross port, and the assembly has one or more packoff seals or bushings disposed in the inner passage of the extension downhole of the flow ports. When the tool disposes in the packer and extension, the smooth exterior surface seals against these one or more packoff seals or bushings when disposed relative thereto. This form of sealing prevents passage of sand and fluids between the tool and the assembly's inner passage. Moreover, by having a smooth external surface along its length, the crossover tool is less likely to become stuck in the inner passage of the assembly when manipulated during operations.

As noted above, the packoff seals or bushings can be disposed downhole of the assembly's flow ports. Additionally, one or more packoff seals or bushings can be similarly disposed in the inner passage uphole of the flow ports. These packoff seals or bushings can be disposed in the bore of the packer, in a portion of the extension, or in a juncture connecting the components together. In any event, the seals or bushings define an internal diameter less than the diameter of the inner passage so the seals or bushings can engage the external surface of the crossover tool.

In one arrangement, these seals or bushings are fixed in the inner passage and can be bushing rings disposed in internal grooves in the passage. In an alternative arrangement, the seals or bushings can be activated between activated and inactivated conditions. For example, a sliding sleeve can move the flexible fingers having distal ends, or some other form of movement of the fingers can be used. When moved, the fingers' distal ends can contract together to form an inner diameter as needed during operations to create the sealing interface with the tool's smooth external surface.

The foregoing summary is not intended to summarize each potential embodiment or every aspect of the present disclosure.

DETAILED DESCRIPTION

Figure 4A:
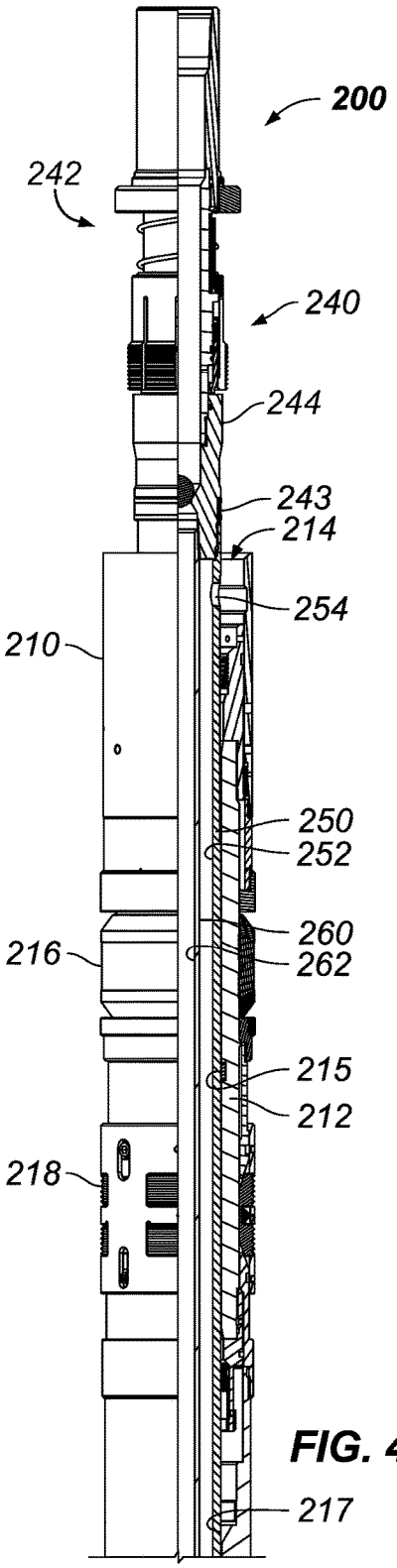
FIGS. 4A-4C show a crossover tool of the present disclosure disposed in portion of a gravel pack assembly.
Figure 4B:
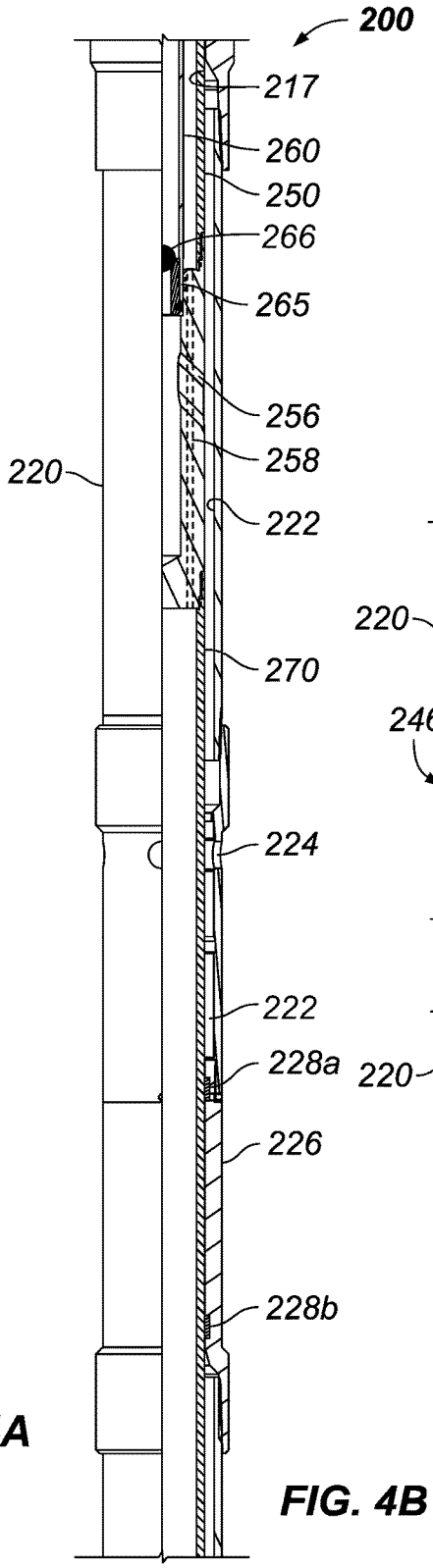
Figure 4C:
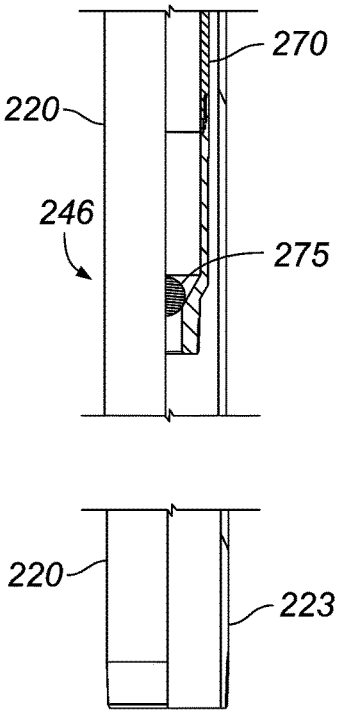

To deal with problems of a crossover tool sticking in a gravel pack assembly, a gravel pack assembly 200 in FIGS. 4A-C uses a different sealing arrangement than the multiple subassemblies and outward facing seals of the prior art. As will be detailed below, a packer 210 and extension 220 of the assembly 200 have inner seals or bushings to engage a smooth external surface of a crossover tool 240.

The packer 210 disposes in a borehole (not shown) and has features to engage the borehole wall, which can be cased or uncased. Typically, the packer 210 has a packing element 216 and slips 218 that can be activated to engage the borehole. The gravel pack extension 220 extends from the packer 210, and the crossover tool 240 can position in various operating positions in the packer 210 and extension 220. Together, these components of the assembly 200 can be used for fracing, gravel packing, and frac/packing. Accordingly, the packer 210 and extension 220 can be used with wellscreens and other components for production in the borehole.

When the packer 210, extension 220, wellscreen and the like are deployed down the borehole, operators set the packer 210 and begin pumping slurry (proppant and/or gravel) after the crossover tool 240 is disposed for circulating in the packer 210 and extension 220. The crossover tool 240 diverts the pumped slurry to the borehole annulus, and the slurry treats the formation or fills the annulus around the extension's screen (not shown) depending on the type of operation. Many of the details of the gravel pack assembly 200 including packer 210, extension 220, and crossover tool 240 and how the assembly 200 operates are similar to those described previously.

Looking in more detail, the packer 210 has a mandrel 212 with an inner bore 214 extending from an uphole end to a downhole end. To engage the surrounding borehole, the packer 210 has the packing element 216 and the slips 218 disposed on the outside of the mandrel 212, and conventional activation can be used to activate the packing element 216 and slips 218.

The gravel pack extension 220 extends from the packer 210, and an inner bore 222 of the extension 220 communicates with the packer's bore 214. In general, the extension 220 can have an extended upper portion that accommodates upper and lower circulating positions and can have a lower portion that extends therefrom. This lower portion can be a standard tubular or the like. At its distal end 223, the extension 220 connects to other components, such as a wellscreen, downhole packer, and other elements as detailed previously.

The extension 220 defines flow ports 224 that communicate the inner bore 222 outside the extension 220 to the surrounding annulus. In between the extension's flow ports 224 and the lower end 223, the extension 220 has a juncture or joint 226 (FIG. 4B) with packoff seals or bushings 228*a-b* disposed in the extension's inner bore 222. In general, the seals or bushings 228*a-b* can be composed of a resilient metal and other materials and may comprise a unitary ring, a split C-ring, a segmented ring, a plain bearing, a sleeve, a clenched bushing, or the like. (In the present disclosure, seal or bushing may be used interchangeably.)

As shown, the inner diameter of the juncture 226 can be smaller than the extension's bore 222, and the pack-off bushings 228*a-b* can have a smaller diameter than the juncture's bore. In this way, the packoff bushings 228*a-b* can engage the crossover tool 140 when disposed therein as described in more detail below.

Figure 5A:
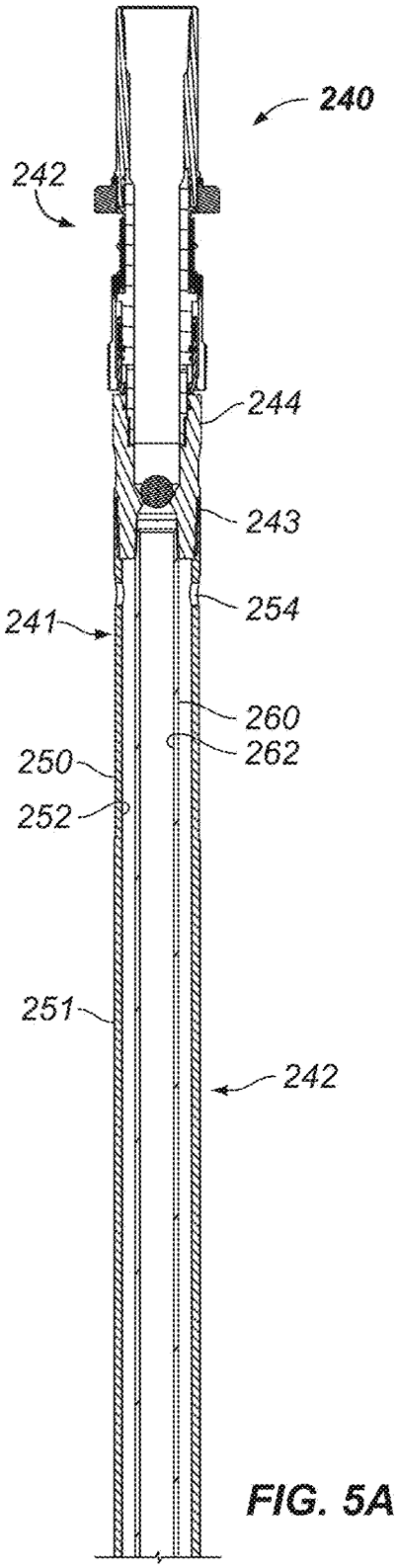
FIGS. 5A-5C show the crossover tool of the present disclosure in more detail.
Figure 5B:
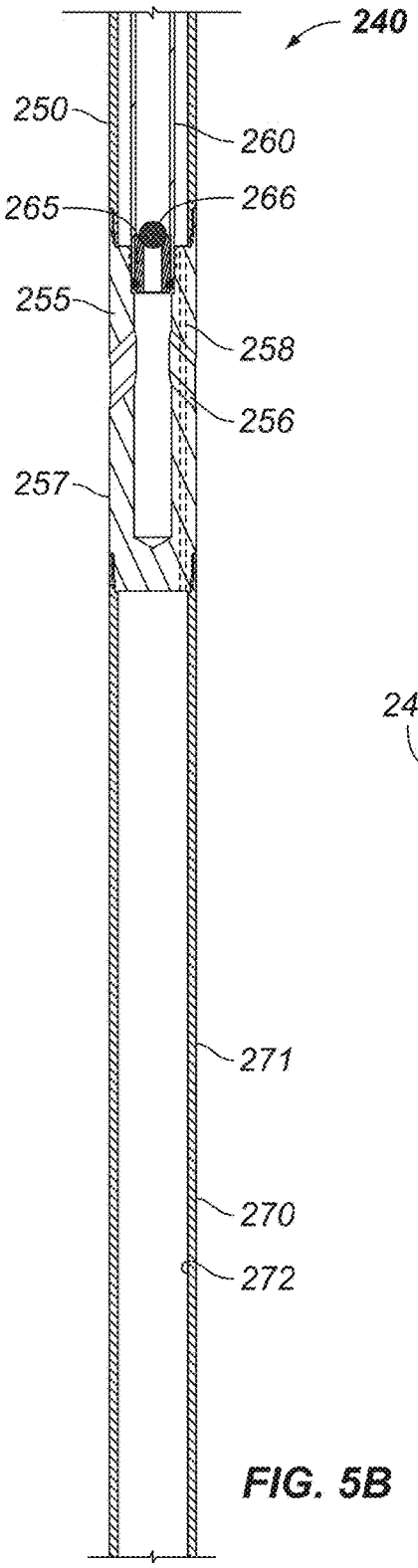
Figure 5C:
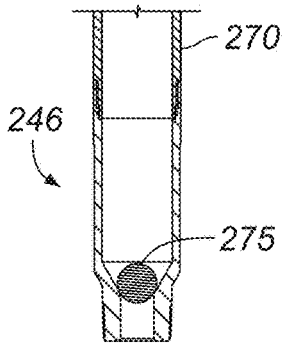

Looking now at the crossover tool 240 in more detail, the crossover tool 240 disposes in the inner bores 214/222 of the mandrel 212 and extension 220 as shown in FIGS. 4A-4C. (Isolated details of the crossover tool 240 are shown in the views of FIG. 5A-5C.) Overall, the crossover tool 240 has a longitudinal tubular body 242 with a smooth exterior surface 241 that runs uniformly along its length.

Figures 1A, 1B, 1C:
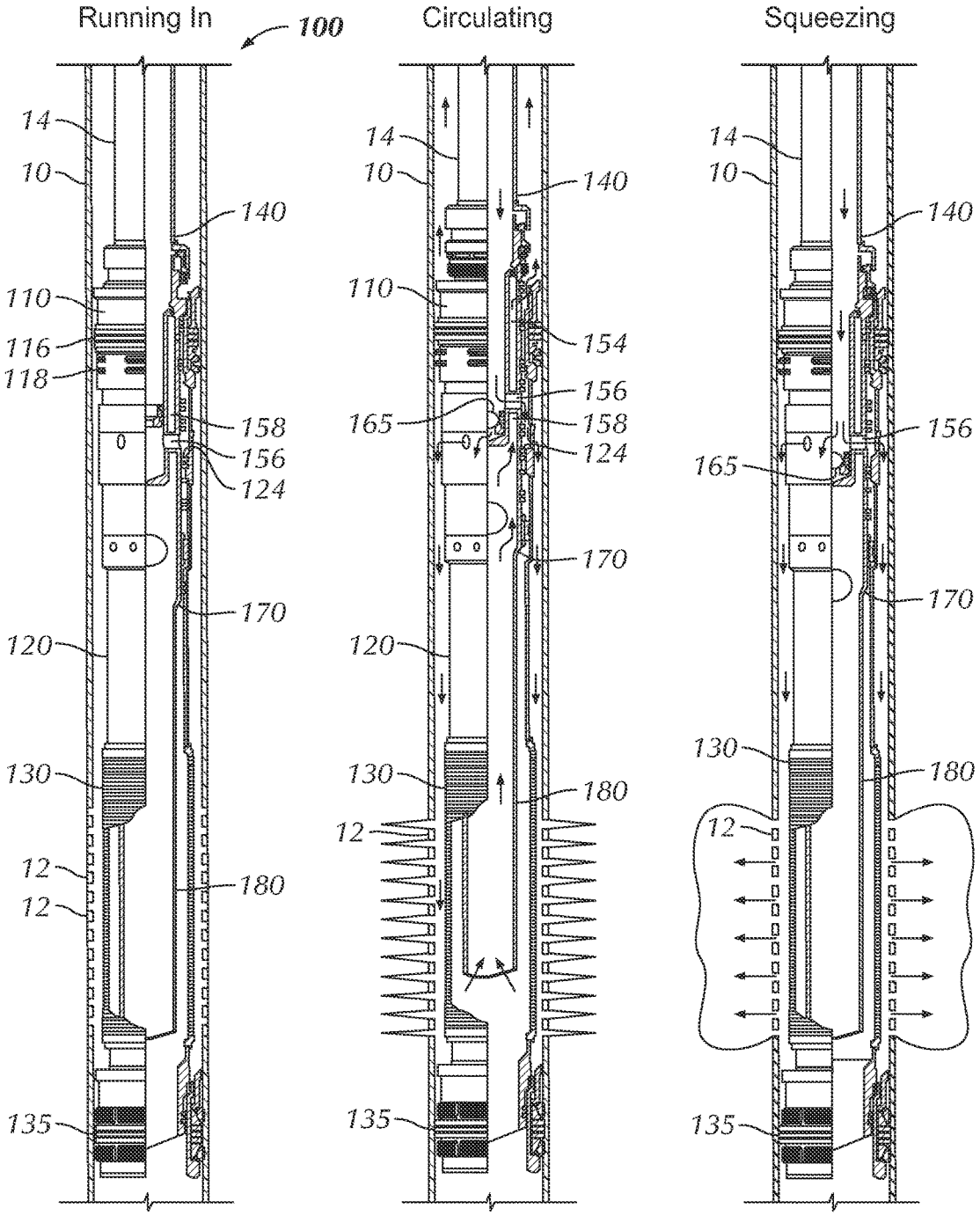
FIG. 1A (Prior Art)
FIG. 1B (Prior Art)
FIG. 1C (Prior Art)
FIGS. 1A-1E shows a gravel pack assembly according to the prior art during different operation conditions.
Figure 1D:
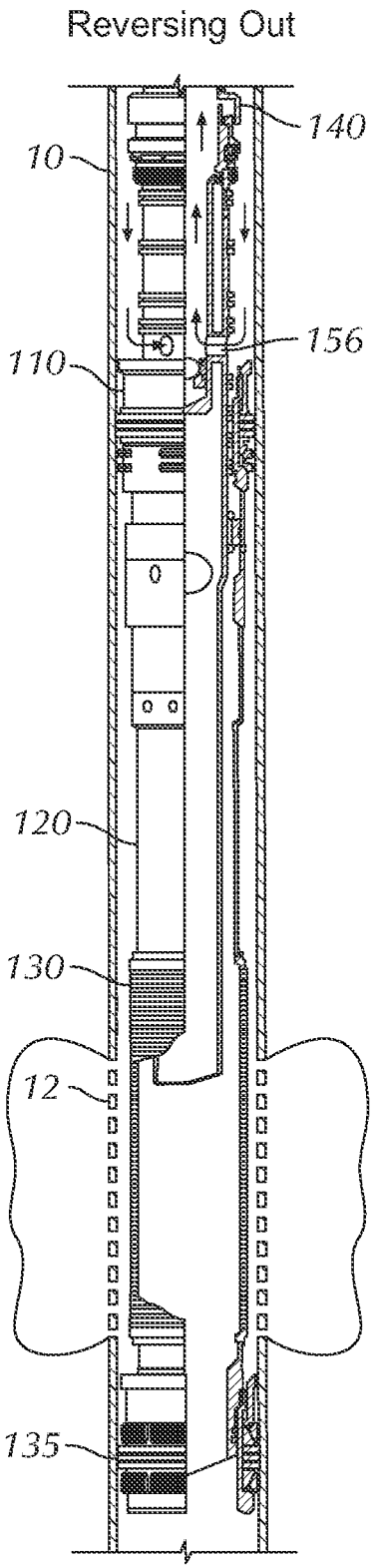
FIG. 1D (Prior Art)

An upper end of the tubular body 242 has an external seal 243 and a latch mandrel 244 for selective sealing as described herein. The external seal 243 engages in the packer's bore 214 when the crossover tool 240 is positioned in a squeeze condition in the assembly 200 (e.g., similar to FIG. 1C) so the return ports 254 do not communicate with the borehole uphole of the packer 210. A setting tool 242 (only a portion of which is shown) attaches to the latch mandrel 244 and is used for setting the packer 210 during operations. The lower end of the crossover tool 240 has a check-valve 246 (i.e., ball and seat arrangement 275) to accept flow into and prevent flow out the lower end.

The body 242 is made of several components to facilitate assembly. For the exterior of the tool 240, these components include an upper outer housing 250, an intermediate housing 255, and a lower outer housing 270 that connect to one another from the latch mandrel 244 to the lower check valve 246. Disposed inside an inner bore 252 of the upper housing 250, an inner housing 260 extends from the latch mandrel 244 to the intermediate housing 255, and in an inner bore 262, the inner housing 260 has a ball seat 265 that can be selectively sealed as described herein. Each of these housings 250/255/260/270 is tubular.

A cross port 256 in the intermediate housing 255 communicates the inner bore 262 of the upper inner housing 260 outside the crossover tool 240, while a bypass 258 in the intermediate housing 255 communicates the annular space between the outer and inner housings 250/260 with the inner bore 272 of the lower housing 270.

The ball seat 265 disposed in between the inner housing 260 and the cross-ports 256 can be selectively activated during operations. For example, a ball 266 can be dropped on the ball seat 265 to close off fluid communication. When sufficient pressure is applied for the purpose of setting the packer 210, the ball 266 and the ball seat 265 move in the intermediate housing 255 below the cross ports 256. This allows the inner housing 260 to communicate outside the crossover tool 240 during operations as described herein.

This crossover tool 240 can be used for conventional operations, especially when conducting a frac-pack operation followed by an annular gravel pack operation. In the frac stage, the crossover tool 240 situates in a squeeze position in the packer 210 and extension 220 as noted previously (See e.g., FIG. 1C). Afterwards, the crossover tool 240 is moved into a circulating position (See e.g., FIG. 1B) so operators can perform the annular gravel pack operation subsequent to the frac operation. In these operations, tool movement can be generally upward after pumping slurry/proppant, which reduces the chance of sticking.

Figure 2A:
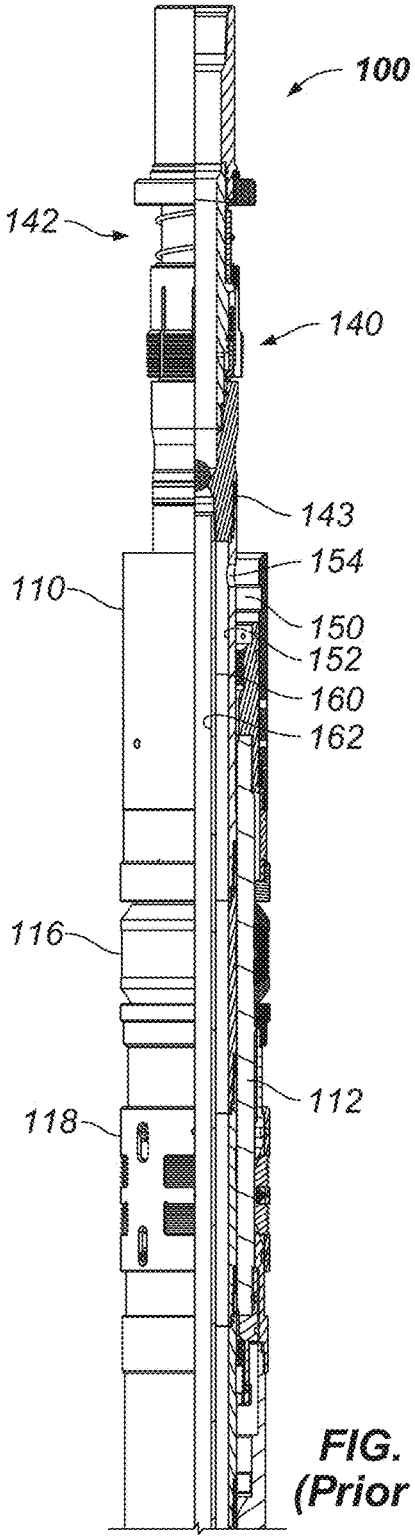
FIG. 2A (Prior Art)
FIGS. 2A-2C show a crossover tool according to the prior art disposed in portion of a gravel pack assembly.
Figure 2B:
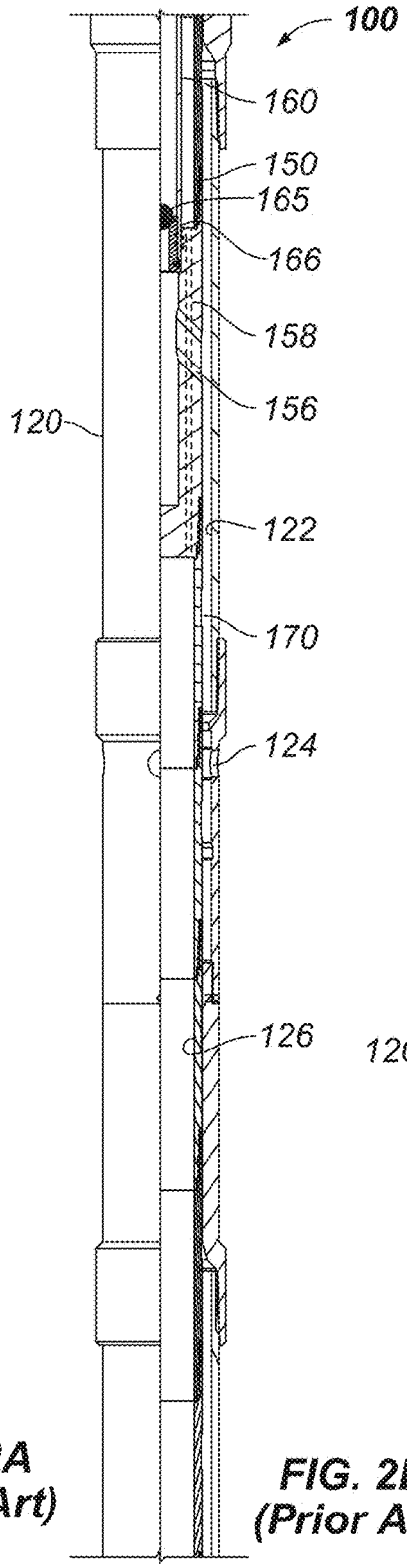
FIG. 2B (Prior Art)
Figure 2C:
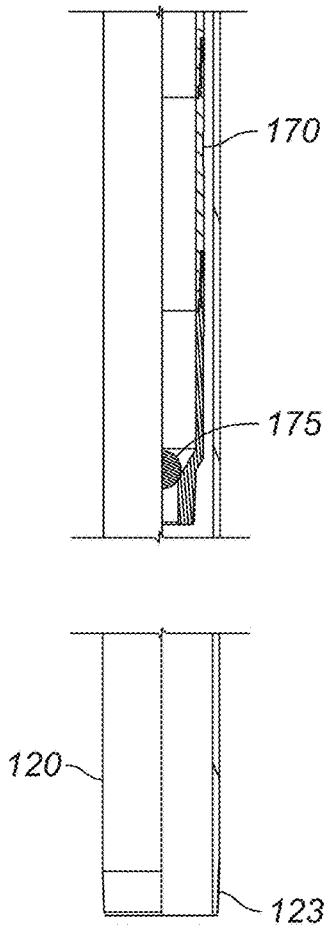
FIG. 2C (Prior Art)
Figure 3A:
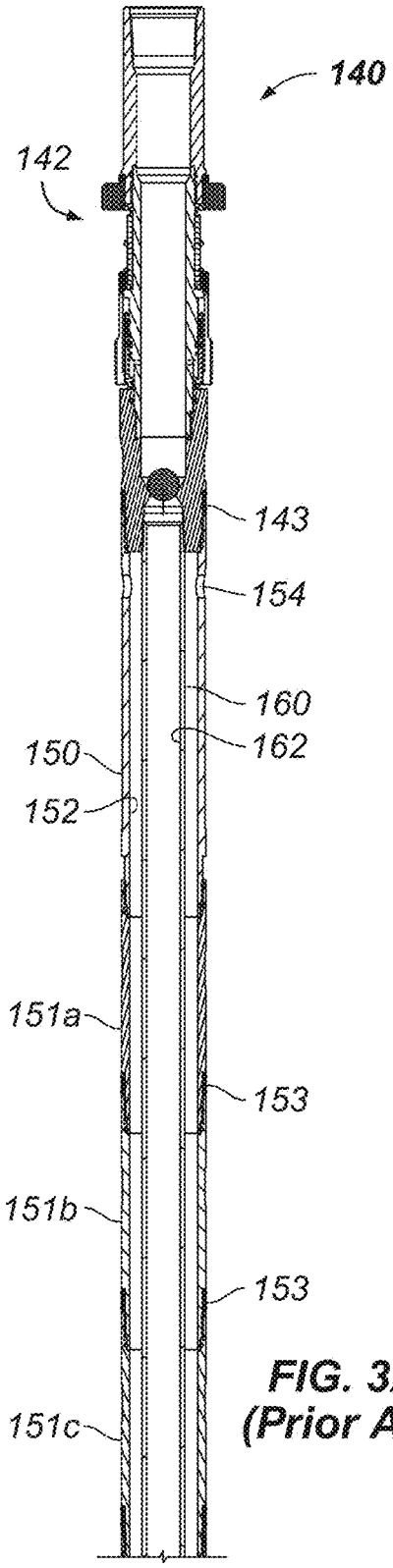
FIG. 3A (Prior Art)
FIGS. 3A-3C show the crossover tool according to the prior art in more detail.
Figure 3B:
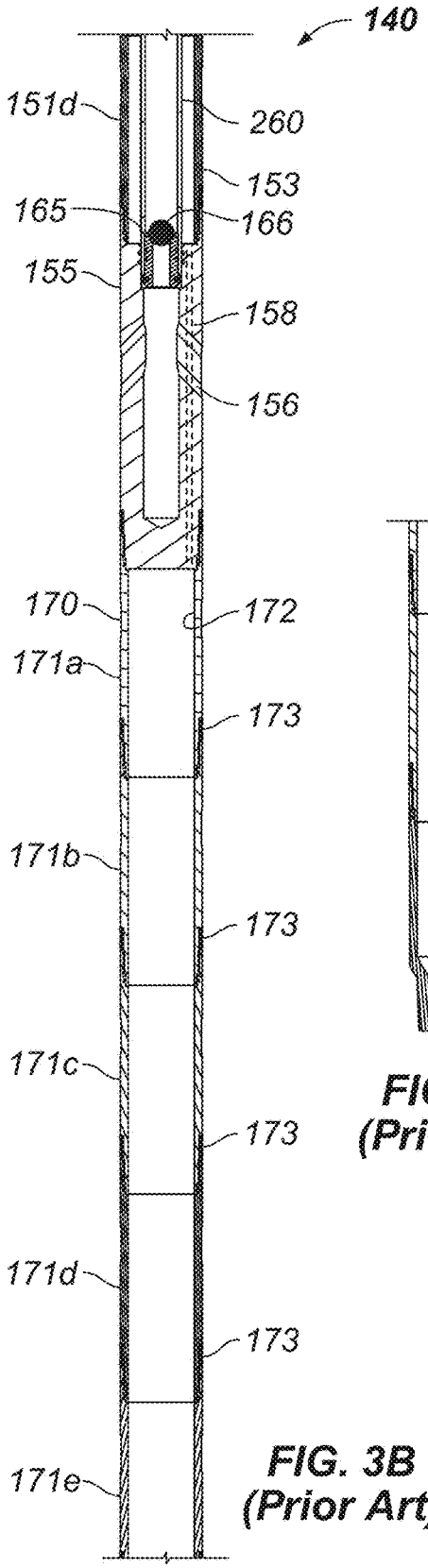
FIG. 3B (Prior Art)
Figure 3C:
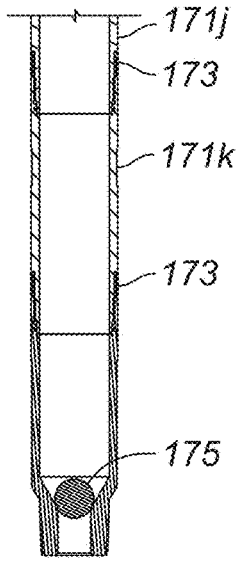
FIG. 3C (Prior Art)

Details of the ball seat 265 in the crossover tool 240 are briefly mentioned for completeness. In the run-in position, the ball seat 265 would be open without a ball 265 seated. For the purpose of being able to apply pressure to the setting tool 242 to set the packer 210, the ball seat 265 would be closed with a dropped ball 266 and moved below the cross ports 256. Accordingly, flow can be diverted to the cross ports 256 as described herein. Meanwhile, the lower check valve 246 allows returns to enter the crossover tool 140 from a connected washpipe (not shown). Squeezing and reversing out positions use the same configuration, although the crossover tool 240 is moved in the assembly 200. Having an understanding of the packer 210, the extension 220, and the crossover tool 240, discussion now turns to features of the assembly 200 that overcome problems with potential sticking of the tool 240 in the packer 210 and extension 220. As noted in the background of the present disclosure, a standard crossover tool (e.g., 140 of FIGS. 2A-2C) has outward-facing seal rings (153/173) that are moved through the stationary polished sealing surfaces (126) of the bore (122) inside the gravel pack assembly (100). These seal rings (153/173) tend to displace gravel, but compress on the tool (140) enough so the crossover tool (140) can be moved in the wellbore. Yet, the conventional tool (140) can be prone to sticking in some circumstances.

In contrast to this conventional approach and to mitigate issues with sticking, the crossover tool 240 of the present disclosure has the longitudinal body 242 with its exterior surface 241, which can be polished smooth using known techniques. In other words, the tubular housings 250/255/270 with exterior surfaces 251/257/271 create a uniform, smooth exterior surface 241 along the tool's length, even though the tool 240 is made up of the several external housings 250/255/270 coupled together for assembly purposes.

The exterior surface 241 can engage the packoff bushings 228*a-b* to seal off communication of fluid and sand in the space between the crossover tool 240 and the body's extension 220 downhole of the gravel pack ports 224. When the crossover tool 240 is moved, for example, the stationary packoff bushings 228*a-b* in the extension 220 do not move sand, and the bushings' seal material does not compress and bind the crossover tool 240. Moreover, the crossover tool 240 can move through an existing column of gravel because the crossover tool 240 essentially has a constant outer diameter along its tubular body 242 without enlarged diameters for seal rings or the like.

Because the upper housing 250 also has its smooth external surface 251 that makes up the body's overall smooth external surface 241, portions inside the packer 210 and/or the extension 220 can also have packoff bushings to engage the external surface 251 uphole of the cross-ports 256 on the tool 240. As shown in FIG. 4A, for example, a packoff seal or bushing 215 can be disposed inside the bore 214 of the packer 210 to engage the tool's upper external surface 251 and seal off communication of fluid and sand in the space between the crossover tool 240 and the packer 210 uphole of the cross ports 256. One or more than one such seal or bushing 215 can be used and can be similar to the other seals or bushings 228*a-b* described herein.

As an alternative or in addition to such a seal or bushing 215 in the packer 210, an internal diameter at a juncture 217 (See FIGS. 4A-4B) of the packer 210 and the extension 220 can have one or more seals or bushings (not shown) similar to those described herein. In fact, this junction 217 with the internal diameter can be any suitable length to accommodate the bushings and can be similar to the juncture 226 on the extension 220 described previously.

Figure 1E:
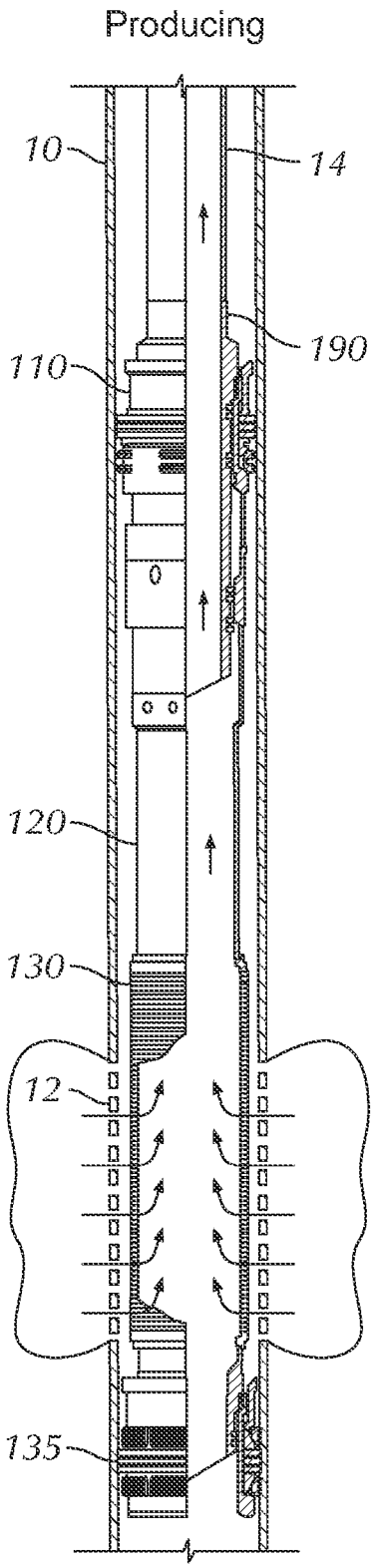
FIG. 1E (Prior Art)

The crossover tool's polished surface 241 and the assembly's stationary packoff seals or bushings (215, 228*a-b*, etc.) can reduce the chances of sticking the crossover tool 240 after pumping proppant/slurry. These features can also reduce drag and seal damage when changing tool positions after pumping the proppant/slurry. If operators want to perform an annular gravel pack operation after a frac operation, the tool 240 can be readily moved to a circulating position because change in position only requires upward movement. In the end, the expanding pack-off bushings on the tool 240 allow conventional seal units to be used on the production seal assembly (i.e., 190; FIG. 1E) to seal in the assembly 200.

Although the smooth surface 241 to the body 242 gives the crossover tool 240 a low drag profile, the smooth surface 241 can be susceptible to damage so it is preferably handled accordingly. Moreover, the internal packoff seals or bushings (i.e., 215, 228*a-b*, etc.) preferably do not reduce the internal diameter 212 below the packer 210 to such an extent that could obstruct the passage of other tools.

If desired, the extension 220 can have a closing sleeve (not shown) that opens and closes repeatedly with the insertion and withdrawal of the crossover tool 240. After gravel packing, for example, the extension's closing sleeve can be closed to isolate the flow ports 224 and prevent the flow between the extension 220 and the annulus. Thus, the crossover tool 240 can have a shifter (not shown) disposed thereon—not unlike the shifter shown below with reference to FIG. 6B. Additionally, the extension 200 can also have a debris barrier (not shown) spaced to fit in this closing sleeve.

In a further feature, packoff seal arrangements mounted in the assembly 200 can be operated with movement of the crossover tool 240. For example, the dimensions of seals or bushings inside the assembly 200 can expand and contract with the movement of the crossover tool 240 so that the resulting seals can be selectively actuated. For example, the bushings 228*a-b* composed of a resilient metal and other materials can comprise a unitary ring, a split C-ring, or a segmented ring and can change diameter when moved relative to an outer groove in the assembly 200. This arrangement may prevent damage to the bushings 228*a-b* when other tools are passed through the assembly 200.

Figure 6A:
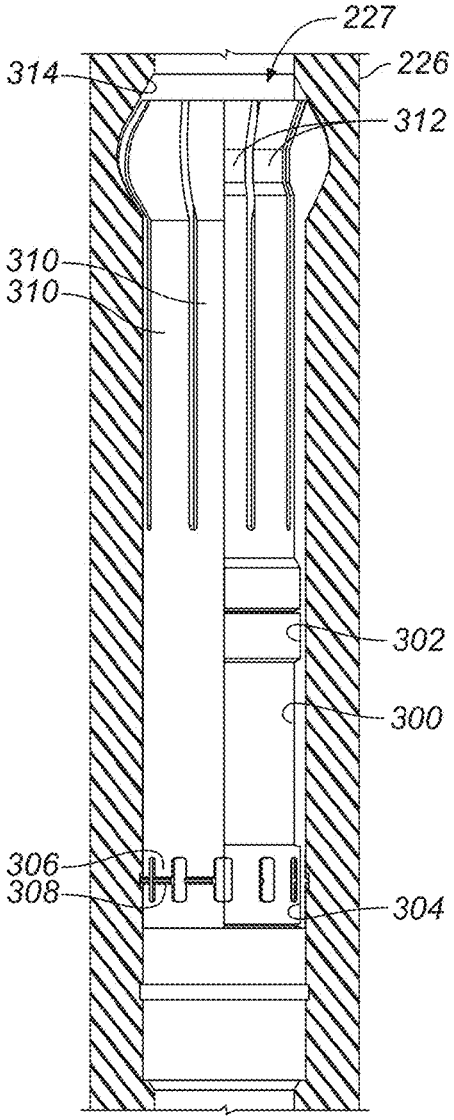
FIGS. 6A-6C show an alternative packoff seal arrangement for the gravel pack assembly that can be activated during operations.
Figure 6B:
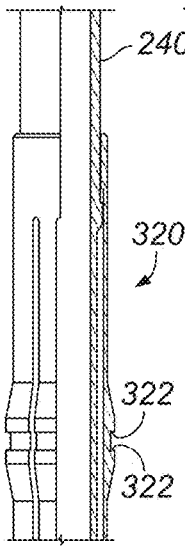
Figure 6C:
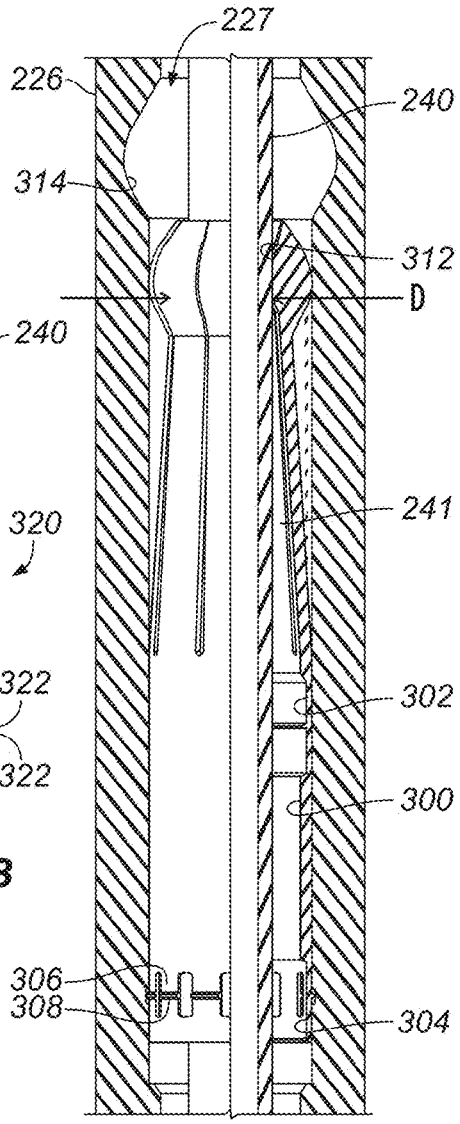

Another actuatable seal arrangement for the gravel pack assembly 200 is shown in FIGS. 6A-6C. In contrast to having fixed or movable bushings as described previously, the seal arrangement shown in FIGS. 6A and 6C uses distal ends 312 on fingers 310, which can be actuated during operations to engage the polished surface 241 of the crossover tool 240.

As shown in FIG. 6A, a sleeve 300 is disposed in the assembly's juncture 226. In general, the sleeve 300 can be similar to the type of closing sleeve used in the extension (220) to selectively open and close fluid communication through the flow ports 224. Thus, the sleeve 300 has upper and lower catches 302 and 304 and has expandable locks 306 with catches 308. When shifted, the sleeve 300 is intended to selectively lock between two positions using the expanding teeth 304 in surrounding grooves of the mandrel's housing and in particular the juncture 226. Other types of locking features known in the art could also be used. Various seals and the like are not shown on the sleeve 300, but these features would be present as needed.

Attached to the sleeve 300, a number of flexible fingers 310 extend in the bore 227 of the joint 226. When inactivated as shown in FIG. 6A, the distal ends 312 of the fingers 310 flex outward and can fit in an internal groove 314 of the joint 226. This essentially allows passage of tools through the joint 226.

To activate this seal arrangement, a shifter 320 as shown in FIG. 6B disposed on the crossover tool 240 is passed through the bore 227 of the joint 226 when the fingers 310 are expanded out as in FIG. 6A. As the shifter 320 passes into the sleeve 300, the shifter 320 preferably passes through the fingers 310 without damaging them. Therefore, the shifting tool 310 may require an extended ramp to move its components away from the finger's distal ends 312 when passed thereby.

Eventually, one of the shifter's catches 322 engages the shifting sleeve 300 on its lower catch 304. At this point, the sleeve 300 then shifts with the downhole movement of the shifter 320. The fingers 310 moves with the sleeve 300, and the fingers' distal ends 312 leave the surrounding groove 314. As this occurs, the distal ends 312 flex together and form a reduced inner sealing diameter D similar to the reduced diameter of the previously described seals or bushings.

Operation of the fingers 310 on the sleeve 300 can be similar to a "hydro-set" or "hydro-trip" sub assembly typically used in a downhole tool to form a seat for a dropped ball. In stark contrast to such a sub assembly, pressure acting against a seated ball and shearing a shear pin connection does not move the sleeve 300 and fingers 310 of the current arrangement. Additionally, the distal ends 312 on the fingers 310 in the present arrangement come together to form the reduced inner sealing diameter D that engages a polished surface 241 on the crossover tool 240. As shown in FIG. 6C, for example, the smooth external surface 241 of the crossover tool 240 reaches the activated distal ends 312 defining the reduced diameter D, and the distal ends 312 seal on the polished surface 241 or at least restrict the movement of fluid and solids between the distal ends 312 and the surface 241.

When the crossover tool 240 is withdrawn, the fingers 310 can be deactivated so that the distal ends 312 expand away from one another into the surrounding groove 314. For example, as the shifter 320 on the crossover tool 240 travels uphole into the sleeve 300, the upper end of the shifter 320 can engage the fingers 310 and move the sleeve 300 uphole so that the fingers' distal ends 312 move back to the corresponding groove 314 similar to FIG. 6A. In this position, the distal ends 312 expand outward and no longer contact the crossover tool 240 or other possible tools that may be passed through the juncture 226.

As will be evident, if an upper catch 302 is used to move the sleeve 300, the shifter's catch 322 must be able to disengage therefrom. Lacking a fixed shoulder on which the shifter's ramp can engage and release the shifter's catch 322 from the sleeve's catch 302, any of a number of other techniques known in the art can be used as will be appreciated one skilled in the art. As one example, the shifter 300 may have an activatable catch 322 on the shifter 320.

As will be appreciated, activation of the fingers 310 can be reversed so that pulling up on the shifter 320 moves the sleeve 300 uphole and pushes the finger's distal ends out of a groove 312. Then, pushing down on the shifter 320 moves the sleeve 300 downhole and pushes the finger's distal ends back into the groove 312.

The activatable seal arrangement from the fingers 310 can allow a production seal assembly (See e.g., 190; FIG. 1E) to use conventional seals when engaging the gravel pack assembly 200. Moreover, any other seal arrangement present on the assembly 200 can also be activatable. For example, any seals 215 inside the packer's bore 214 or on an internal diameter at the juncture 217 of the extension 220 and the packer 210 can have one or more similarly activatable seal arrangement.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A borehole gravel pack assembly, comprising:

a body disposing in the borehole, the body having an inner passage from a proximal end to a distal end and defining a flow port communicating the inner passage outside the body;

a first packoff seal disposed in the inner passage of the body between the flow port and the distal end;

a second packoff seal disposed in the inner passage of the body between the flow port and the proximal end; and a crossover tool disposing in at least first and second positions in the inner passage of the body, the crossover tool having first and second open ends, a cross port towards the first open end, and a return port towards the second open end, the crossover tool having a smooth exterior surface on first and second sides of the cross port, the smooth exterior surface sealing against the first and second packoff seals when disposed relative thereto, whereby in the first position, the smooth exterior surface on the first and second sides of the cross port seals respectively against the first and second packoff seals such that the cross port communicates slurry from the second open end of the tool to the flow port of the body and the return port communicates fluid returns from the first open end of the tool to the proximal end of the body; and whereby in the second position, the smooth exterior surface on the first side of the cross port seals against the second packoff seal such that the cross port communicates circulation from the proximal end of the body to the second open end of the tool.

2. The assembly of claim 1, wherein a portion of the inner passage of the body comprises a reduced diameter, the first packoff seal disposed at the reduced diameter.

3. The assembly of claim 2, wherein the first packoff seal comprises a pair of bushings disposed inside the reduced diameter.

4. The assembly of claim 3, wherein the bushings dispose in internal grooves defined about the reduced diameter.

5. The assembly of claim 1, wherein the first packoff seal is movable between an inactivated condition and an activated condition in the inner passage, the first packoff seal in the activated condition engaging the smooth exterior surface of the crossover tool when disposed relative thereto.

6. The assembly of claim 5, wherein the body comprises a sleeve movably disposed in the inner passage, the sleeve moving the first packoff seal between the inactivated and activated conditions.

7. The assembly of claim 6, wherein the crossover tool comprises a shifter disposed thereon, the shifter selectively moving the sleeve in the inner passage when shifted relative thereto.

8. The assembly of claim 6, wherein the first packoff seal comprises a plurality of flexible fingers movable with the sleeve, distal ends of the flexible fingers contracting together when in the activated condition and forming a reduced diameter for sealing against the smooth exterior surface of the crossover tool.

9. The assembly of claim 1, wherein the body comprises means disposed outside the body for engaging in the borehole.

10. The assembly of claim 1, wherein the first open end of the crossover tool comprises a one-way valve permitting fluid communicating into the crossover tool.

11. The assembly of claim 1, wherein the body comprises a wellscreen disposed on the distal end and communicating the borehole with the inner passage of the body.

12. The assembly of claim 1, wherein the crossover tool disposed in the body in a third position seals the smooth exterior surface on the first and second sides of the cross port respectively against the first and second packoff seals such that the cross port is disposed in fluid communication with the flow port of the body and the return port is sealed from fluid communication with the borehole uphole of the body.

13. The assembly of claim 1, wherein the crossover tool comprises:

an inner housing defining a first passage communicating with the second open end; and an outer housing defining a second passage communicating with the first and second open ends and disposed about the inner housing, the return port defined in the outer housing and communicating the second passage outside the outer housing, the cross port defined in the outer housing and communicating the first passage outside the outer housing.

14. The assembly of claim 13, wherein the crossover tool comprises means disposed between the first passage and the cross port for selectively preventing fluid communication from the first passage out the cross port.

15. The assembly of claim 13, wherein the outer housing comprises an intermediate portion defining a bypass passage communicating with the first and second ends, the intermediate portion defining the cross port communicating the first open end outside a side of the intermediate portion.

16. The assembly of claim 15, wherein the outer housing comprises:

a first tubular connected to one end of the intermediate portion; and a second tubular connected to another end of the intermediate portion.

17. The assembly of claim 16, wherein the first and second tubulars each have a portion of the smooth exterior surface of the crossover tool.

18. A borehole gravel pack assembly, comprising:

a body disposing in the borehole and having a proximal end and a distal ends, the body having an inner passage from the proximal end to the distal end and defining a flow port communicating the inner passage outside the body;

a crossover tool disposing in at least first and second positions in the inner passage of the body, the crossover tool having first and second open ends, a cross port towards the first open end, and a return port towards the second open end, the crossover tool having a smooth exterior surface on first and second sides of the cross port;

first means disposed in the inner passage of the body between the flow port and the distal end for sealing against the smooth exterior surface of the crossover tool when disposed relative thereto; and second means disposed in the inner passage of the body between the flow port and the proximal end for sealing against the smooth exterior surface of the crossover tool when disposed relative thereto, whereby in the first position, the smooth exterior surface on the first and second sides of the cross port seals respectively against the first and second means such that the cross port communicates slurry from the second open end of the tool to the flow port of the body and the return port communicates fluid returns from the first open end of the tool to the proximal end of the body; and whereby in the second position, the smooth exterior surface on the first side of the cross port seals against the second means such that the cross port communicates circulation from the proximal end of the body to the second open end of the tool.

19. The assembly of claim 18, wherein the first means for sealing comprises means for being activated to seal against the smooth exterior surface.

20. The assembly of claim 19, wherein the crossover tool comprises means activating the first means.

* * * * *